US005133503A

United States Patent [19]

Giordano et al.

[11] Patent Number: 5,133,503

[45] Date of Patent: Jul. 28, 1992

[54] SWIMMING POOL CLEANING DEVICE FOR CLEANING SUBMERGED SWIMMING POOL SURFACES WITH DIRECT PRESSURIZED AND INTENSIFIED WATER CURRENT

[76] Inventors: Jeffrey R. Giordano; Christopher S. Backos, both of 28161 Haxton Dr., Canyon Country, Calif. 91351

[21] Appl. No.: 656,218

[22] Filed: Feb. 15, 1991

[51] Int. Cl.[5] ..... B05B 1/04; B05B 15/08

[52] U.S. Cl. ..... 239/532; 239/589; 239/598; 134/167 R

[58] Field of Search ..... 239/280, 280.5, 281, 239/289, 532, 589, 597, 598; 134/167 R, 168 R

[56] References Cited

U.S. PATENT DOCUMENTS

| | | | |
|---|---|---|---|
| 900,869 | 10/1908 | Murphy | 239/598 |
| 1,557,477 | 10/1925 | Klinkhammer | 239/532 |
| 1,653,907 | 12/1927 | Hilgerink | 239/532 |
| 1,721,449 | 7/1929 | Helmeke | 239/532 |
| 2,789,865 | 4/1957 | Shannon | 239/532 |
| 2,852,307 | 9/1958 | Clark | 239/280 |
| 3,226,259 | 12/1965 | Armbrust . | |
| 3,245,420 | 4/1966 | Cherney . | |
| 3,707,737 | 1/1973 | Brower . | |
| 3,716,883 | 2/1973 | Monroe . | |
| 3,796,373 | 3/1974 | Moore | 134/167 R |
| 4,030,148 | 6/1977 | Rosenberg . | |
| 4,247,216 | 1/1981 | Pansini . | |
| 4,365,375 | 12/1982 | Grodin et al. . | |
| 4,734,954 | 4/1988 | Greskovics et al. . | |
| 4,750,883 | 6/1988 | Drake | 239/532 |
| 4,982,896 | 1/1991 | Crow | 239/532 |

FOREIGN PATENT DOCUMENTS

| | | | |
|---|---|---|---|
| 69433 | 7/1945 | Norway | 239/280.5 |
| 580795 | 9/1946 | United Kingdom . | |
| 2150423 | 7/1985 | United Kingdom . | |

*Primary Examiner*—Andres Kashnikow
*Assistant Examiner*—William Grant
*Attorney, Agent, or Firm*—Thomas I. Rozsa

[57] ABSTRACT

A swimming pool cleaning device having a first portion and a second portion obliquely offset from each other. The first portion has a clip assembly for adapting into a conventional swimming pool cleaning pole. The second portion has a hollow with a large aperture and a slit aperture where the hollow is gradually converged towards the slit aperture. The second portion also has a nozzle assembly extended to the large aperture for adapting a conventional water hose such that water from the water hose can flow through the large aperture into the hollow. People can use the cleaning pole to control the underwater movement and orientation of the cleaning device. Pressurized water supplied by the water hose will pass through the converged hollow of the cleaning device and spurt out of the slit aperture. This pressurized and intensified water current directly cleans the submerged swimming pool surfaces.

8 Claims, 1 Drawing Sheet

SWIMMING POOL CLEANING DEVICE FOR CLEANING SUBMERGED SWIMMING POOL SURFACES WITH DIRECT PRESSURIZED AND INTENSIFIED WATER CURRENT

BACKGROUND OF THE INVENTION

1. Field of the Invention

The present invention relates to the field of swimming pool cleaning devices. More particularly the present invention relates to the field of swimming pool cleaning devices for cleaning submerged swimming pool surfaces.

2. Description of the Prior Art

Many prior art patents have disclosed various kinds of swimming pool cleaning devices:

1. U.S. Pat. No. 3,226,259 issued to Armbrust on Dec. 28, 1965 for "Method For Cleaning A Submerged Surface" (hereafter the "Armbrust Patent").
2. U.S. Pat. No. 3,245,420 issued to Cherney on Apr. 12, 1966 for "Cleaning Apparatus For Liquid Containers" (hereafter the "Cherney Patent").
3. U.S. Pat. No. 3,707,737 issued to Brower on Jan. 2, 1973 for "Apparatus For Cleaning Submerged Surfaces" (hereafter the "Brower Patent").
4. U.S. Pat. No. 3,716,883 issued to Monroe on Feb. 20, 1973 for "Fluid Driven Cleaning Implement For Swimming Pools" (hereafter the "Monroe Patent").
5. U.S. Pat. No. 4,030,148 issued to Rosenberg on Jun. 21, 1977 for "Swimming Pool Surface Cleaning Device" (hereafter the "Rosenberg Patent").
6. U.S. Pat. No. 4,247,216 issued to Pansini on Jan. 27, 1981 for "Quick Connect Handle For Swimming Pool Cleaning Tools" (hereafter the "Pansini Patent").
7. U.S. Pat. No. 4,365,375 issued to Grodin et al. on Dec. 28, 1982 for "Vacuum Nozzle For Pool Cleaning" (hereafter the "Grodin Patent").
8. U.S. Pat. No. 4,734,954 issued to Greskovics et al. on Apr. 5, 1988 for "Pool Scrubber Device" (hereafter the "Greskovics Patent").
9. British Patent No. 580,795 issued to Ackers on Sept. 19, 1946 for "Improved Means For cleaning The Glass of Aquaria" (hereafter the "Ackers Patent").
10. British Patent No. 2,150,423 issued to Panton on Jul. 3, 1985 for "Underwater Brooms" (hereafter the "Panton Patent").

The Greskovics Patent discloses a water-driven scrubber device 10 used in scrubbing wall and floor surfaces of a swimming pool or the like. The Greskovics Patent device 10 driven by the water-powered motor. The device 10 further has a mounting yoke 60 for attaching a standard pool service utility pole to the device 10. It also has a hose fitting 30 for connecting a standard water hose to the device 10. In addition the device 10 has a conduit 34 and a narrow cross section jet port 36 within the housing of the device 10 for conducting pressurized water. However, in the Greskovics Patent the pressurized water is directed into the water-powered motor, therefore the surfaces of the swimming pool are cleaned by the rotating scrubbers.

The Grodin Patent discloses a vacuum nozzle 1 particularly adapted for use in conjunction with a conventional swimming pool brush 3 for removing leaves and debris from the floor of a pool having a flexible liner. The Grodin Patent nozzle 1 comprises a housing 11 which has a hose coupling 13 adapted to accept a hose 15 at one end, and an elongated nozzle mouth 17 positioned to be above a pool brush 3 at the other end. The nozzle 1 further has an extension 19 for attaching the nozzle 1 to the pool brush 3. However, the Grodin Patent is a sucking device which sucks water out of the pool instead of spouting water into the pool, therefore the nozzle mouth 17 of the Grodin Patent nozzle 1 is constructed with an elongated opening which is larger than a normal jet port for pressurizing water, so that leaves and debris from the floor of the swimming pool can be sucked into the housing 11 of the nozzle 1.

The Pansini Patent discloses a connect handle for swimming pool cleaning tools. Designed for a standard swimming pool cleaning pole 10 having a hollow end with two pairs of oppositely disposed holes 12 and 14 on its circumference, the Pansini Patent comprises a hollow handle connector 16 with three pairs of oppositely disposed holes 18, 20 and 22, and a wishbone-shaped spring member 24 having two spring arms 26 and 28 with a pair of locking bottoms 30 and a pair of thumb bottoms 32. The pair of locking bottoms 30 are located on the two spring arms respectively and adapted to be extended into the pair of holes 12 of the cleaning pole 10 and the pair of holes 20 of the handle connector 16. However, the Pansini Patent handle connector 16 itself is not a swimming pool cleaning tool but merely a connector for swimming pool cleaning tools.

The Rosenberg Patent discloses a swimming pool surface cleaning device 18 comprising a swingable arm 37 pivotally mounted to an edge 20 of the swimming pool 12. Pressurized in a spray over the surface of the water by a fitting 46 attached to the end of the swingable arm 37 to urge debris on the surface of the water toward the skimmer for more rapid cleaning of the water surface. However, the Rosenberg Patent device is designed for the purpose of cleaning the water surface of a swimming pool but not the sidewall or bottom surface of the swimming pool itself, and a float 58 is added to the fitting 46 to keep the end of the swingable arm 37 above the waterline exclusively for this purpose.

The Monroe Patent discloses a water-driven cleaning implement for swimming pools. It has an elongated hollow handle 12 having one end connected to a water supply and the other end to a T-shaped housing 13 of a pair of rotatable brushes 16. Inside the hollow handle 12 there is a water-powered motor means with vaned impellers 29. However, the Monroe Patent is similar to the Greskovics Patent where pressurized water is used primarily to drive cleaning attachments such as brushes or scrubbers, but not to directly clean the surfaces of the swimming pool.

The Brower Patent discloses an apparatus 11 for cleaning submerged surfaces. The cleaning apparatus 11 comprises a hollow handle 12, a jet pump means 17 and a resilient sponge pad 30. Inside handle 12, a flexible water relatively negative pressure within a tubular hollow chamber 120 inside the sponge pad 30 which is disposed against the submerged surface of a swimming pool. The relative negative pressure urges the compressible sponge pad 30 toward the submerged surface to conform to the contour of the surface which helps to clean the surface more effectively. However, the pressurized water sent into the jet pump means 17 of the Brower Patent does not directly spout onto the submerged surface but rather spouts out through an outlet tube 119 which is perpendicular to the submerged surface.

The Cherney Patent discloses a cleaning apparatus for liquid containers comprising a collector hood 20. The Cherney Patent collector hood 20 has means for receiving a handle 21 and a water inlet hose 35 connected to a siphon device, and a distributer pipe 36 with several nozzles 37 connected to the hose 35. Water flows into the collector hood 20 through siphon hose 35 and is ejected through nozzles 37 on distributer pipe 36. However, the Cherney Patent apparatus is designed to work in conjunction with a siphon device rather than pressurized water, and the collector hood 20 further has means for receiving a water outlet hose 19 which is used for sucking water out and back to the siphon device to collect the sediment from the underwater surfaces of the liquid container.

The Armbrust Patent discloses a method for cleaning a submerged surface which essentially involves using a device to seal a small area of a submerged surface and vacuuming the small area, then conducting a chemical solution to the small area for chemical treatment. However, the Armbrust Patent is a method of treating the submerged surfaces with chemical solution and therefore involves a complicated vacuuming device and process.

The Ackers Patent, one of the two British Patents, discloses an improved means for cleaning the glass of aquaria comprising a siphon tube having one end formed as a flattened funnel and attached with a scrapper. However, the Ackers Patent is a siphon device which only sucks water out of the water container but does not spout water into the water container.

The Panton Patent, the other one of the two British Patents, discloses an underwater broom having a flap hingeably attached to the broomhead for flapping through the water as the broomhead travels to create a thrust on the broomhead toward the underwater surface to be cleaned. However, the Panton Patent is merely a broom which is not designed to be used in conjunction with water hoses.

The most difficult and time consuming problem involved in swimming pool cleaning is the cleaning of algae and bacteria in the swimming pool. Algae and bacteria adhere to the submerged swimming pool surfaces, especially during the summertime when algae destroying chemicals break down due to the strong sunlight. Removing algae and bacteria is the most difficult and time consuming aspect of pool cleaning because scrubbers, brushes and brooms cannot reach algae and bacteria embedded in cracks, in corners, or around difficult-to-reach areas such as steps, skimmers, and tile. In addition, since pool plaster is very porous, scrubbers, brushes, and brooms can only remove algae and bacteria on the surface (outer layer) of the plaster, not the algae and bacteria embedded in the pores or rough areas of plaster.

Instead, in most cases direct pressurized water is able to wash off algae and bacteria from the submerged surfaces. Most people have conventional water hoses at their home. But conventional water hoses are usually very flexible. It is hard to direct an open end of a flexible hose to a certain desired place under the water surface by handling the hose along its length at a location remote from the open end. In addition, water flowing out from the submerged open end of a water hose is often not strong enough to form a concentrated water current. On the other hand, most people have conventional swimming pool cleaning poles for their swimming pool cleaning jobs. Conventional swimming pool cleaning poles are usually long rigid rods have two ends. Various swimming pool cleaning devices can be attached to one end of the poles. People then handle the other end of the poles to control the movements of the attached devices. However, no prior art patent discloses a simple and handy device which can be quickly attached with both the open end of a flexible conventional water hose and a conventional swimming pool cleaning pole, for applying pressurized water directly against a submerged swimming pool surface.

SUMMARY OF THE PRESENT INVENTION

The present invention is a swimming pool cleaning device for cleaning submerged swimming pool surfaces with direct pressurized and intensified water current.

It is known that algae and other bacteria are often collected on the submerged swimming pool surfaces. Using pressurized and intensified water current usually can wash them off. However it is hard to control an open end of a flexible conventional water hose under the water surface, and water current ejected from a submerged open end of a water hose is sometimes not strong enough.

It is therefore an object of the present invention to provide a swimming pool cleaning device for applying pressurized and intensified water current directly onto submerged swimming pool surfaces to clean off algae and bacteria collected thereon.

It is also an object of the present invention to provide a swimming pool cleaning device which can be quickly attached to an end of a conventional swimming pool cleaning pole, so that people can control its underwater movement by using the pole.

It is again an object of the present invention to provide a swimming pool cleaning device which can be readily used with a conventional water hose for a simple pressurized water supply.

It is a further object of the present invention to provide a swimming pool cleaning device which can concentrate and intensify the water ejected from the water hose so that it can spurt forceful water current onto the submerged swimming pool surfaces.

It is an additional object of the present invention to provide a swimming pool cleaning device which can aim and deliver pressurized water directly onto the submerged swimming pool surfaces.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Figure 1:
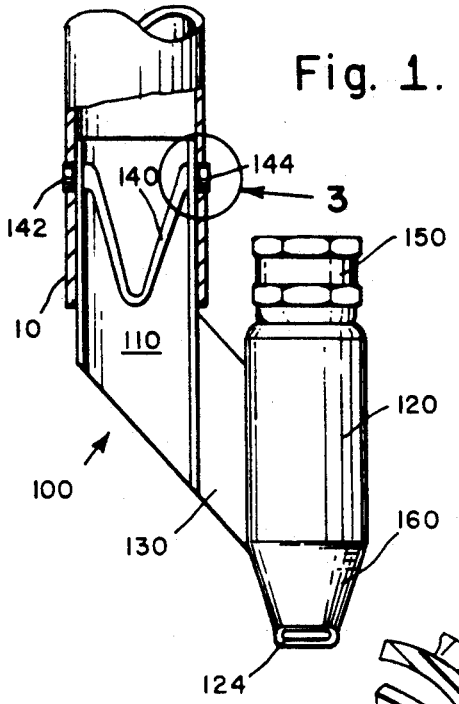
FIG. 1 is a plan view of the present invention swimming pool cleaning device.
Figure 2:
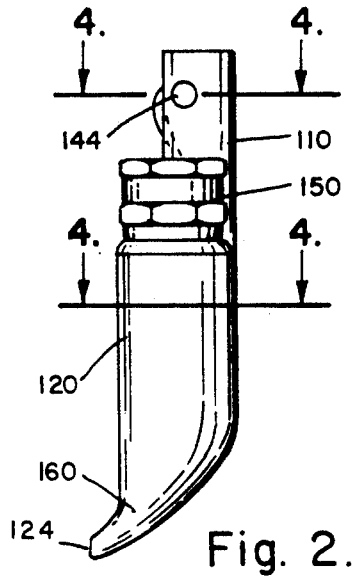
FIG. 2 is a side view of the present invention swimming pool cleaning device.
Figure 3:
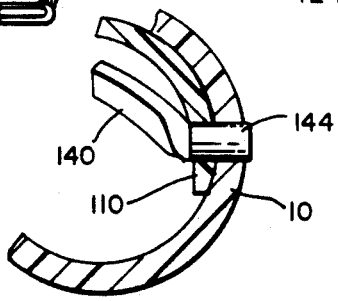
FIG. 3 is a partial cross sectional view of the first portion of the present invention swimming pool cleaning device highlighting the area of the first portion encircled in FIG. 1.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a swimming pool cleaning device used in conjunction with a conventional swimming pool cleaning pole and a conventional water hose, for spurting and directing pressurized and intensified water current to clean algae, bacteria and other debris off the submerged surfaces of a swimming pool.

Referring to FIGS. 1–4, there is shown at 100 respectively the plane, side, and end view of the present invention swimming pool cleaning device. Swimming pool cleaning device 100 has a first portion 110 and a second portion 120. First portion 110 and second portion 120 are bridged by an angled portion 130 such that first portion 110 and second portion 120 are obliquely offset from each other. The cross-section of first portion 110 is generally semi-circular. A standard conventional swimming pool cleaning pole has at least one hollow end with several pairs of small holes on the sidewall. At least part of first portion 110 is adapted to be inserted into the hollow end of a conventional swimming pool cleaning pole. Attached to first portion 110 there is a wishbone-shaped clip 140 which has 144 protrude outwardly so they can be accommodated in one of the several pairs of small holes at the hollow end of the attachment. Pushing prongs 142 and 144 inwardly will release the attachment. The cross section of second portion 120 is generally circular. Second portion 120 has a hollow 118 through its body serving as a water conduit. The hollow 118 of second portion 120 has two openings: a large opening 122 at its top end and a small opening 124 at its bottom end. The hollow 118 of second portion 120 forms a water conduit and gradually converges towards small opening 124. Second portion 120 is also archwise shaped towards small opening 124. Second portion 120 further has a nozzle means 150 at its top end and a jet means 160 at its bottom end. Nozzle means 150 is used for adapting an end of the conventional water hose and is extended to large opening 122, such that water from the water hose can flow into the hollow 118 of second portion 120 through large opening 122. By way of example, nozzle means 150 has interior screw threads for fastening most standard conventional water hoses. Jet means 160 is configured for directing water current spurting out from the hollow of second portion 120 and is extended to small opening 124. The hollow 118 of second portion 120 is converged from its large opening 122 to its small opening 124, and is arcuately curved towards its small opening 124. Jet means 160 extends towards a direction which is generally perpendicular to second portion 120. After pressurized water from the conventional water hose enters the hollow 118 of second portion 120, it is further pressurized and intensified as it flows through the hollow 118 towards small opening 124, and as a result, it spurts out from jet means 160 as pressurized and intensified water current which can be directly applied to a submerged swimming pool surface. Alternatively, jet means 160 may be part of the structure of second portion 120 and not necessarily a separate piece. In fact, a slit opening as the small opening of the hollow may well serve as a jet means.

Figure 4:
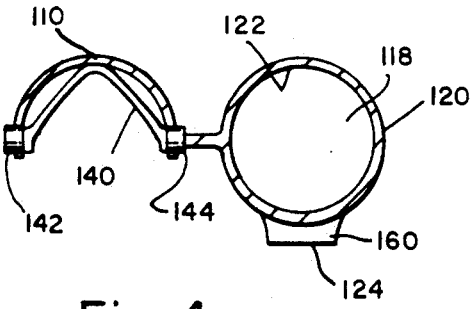
FIG. 4 is a cross sectional view taken along two pairs of lines 4—4 of FIG. 2.
Figure 5:
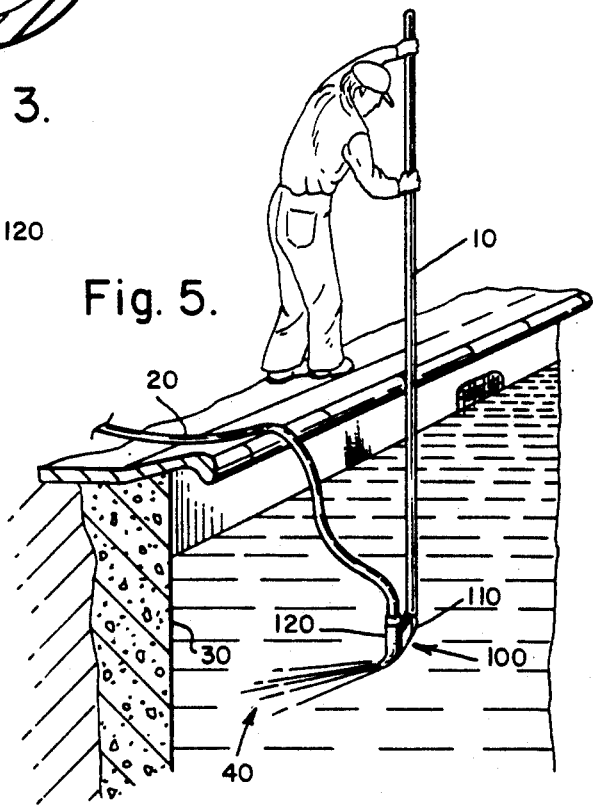
FIG. 5 is a perspective view of the operation of the present invention swimming pool cleaning device, used in connection with a hose connected to a source of water, and also attached to a pole.

FIG. 5 is a perspective view of the operation of the present invention swimming pool cleaning device. As illustrated in FIG. 4, the present invention swimming pool cleaning device 100 is attached to the lower end of a conventional swimming pool cleaning pole 10. The lower end of cleaning pole 10 is attached to cleaning device 100 by clip means 140 on first portion 110. A person is holding the upper end of cleaning pole 10. A conventional water hose 20 is connected to cleaning device 100 at its one end and a conventional water supply at its other end. Water hose 20 is connected to cleaning device 100 by nozzle means 150 on second portion 120. To clean a submerged surface 30 of a swimming pool, the person can use the cleaning pole to such that jet means 160 is pointed to where algae or other debris 40 have collected. Pressurized water supplied through water hose 20 is further pressurized and intensified when it is passed through the hollow 118 of second portion 120 of cleaning device 100. The pressurized and intensified water current spurting out from jet means 160 of cleaning device 100 is strong and forceful so it can wash off algae or other debris 40 from submerged swimming pool surface 30. First portion 110 and second portion 120 of cleaning device 100 are offset from each other by angled portion 130, so that cleaning pole 10 and water hose 20 respectively attached to them will not be twined or tangled to each other. By having the jet means 160 directed at an angle to second portion 120, the person can stand vertically above the pool and move the pole 10 up and down in a conventional manner while the jet of water is directed transversely against the swimming pool surface.

By way of example only, the cleaning device may be made of rigid plastic material. First, second and third portions 110, 120 and 130 may be made of one unitary piece of plastic. Clip 140 may be made of thin plastic or metal wire The present invention swimming pool cleaning device 100 is durable for long time use, light weight for easy handling, and simply constructed for quick cleaning.

Defined in detail, the present invention is a swimming pool cleaning device adapted to be used with a conventional swimming pool cleaning pole and a conventional water hose, comprising: (a) a first portion and a second portion, the first portion and the second portion obliquely bridged and offset by an angled portion; (b) the first portion having clip means for attachment to the cleaning pole; (c) the second portion having a hollow with a first aperture and a second aperture, nozzle means for connection to the water hose, and jet means for spurting water; (d) the second portion being curved from said first aperture towards the second aperture, and the hollow gradually converged from said first aperture towards the second aperture; (e) the nozzle means extended to the first aperture such that water from the water hose can flow through the first aperture into the hollow; and (f) the jet means extended to the second aperture such that water in the hollow can flow through the second aperture and spurt out from the jet means; (g) whereby direct pressurized and intensified water current can be spurted out of the jet means to clean submerged swimming pool surfaces.

In one of the preferred embodiments of the present invention defined in detail: (a) the first portion, the second portion and the angled portion are made of an unitary piece of solid plastic; (b) the first portion is generally semi-circular in cross-section; (c) the second portion is generally circular in cross-section; (d) the angled portion is generally flat in cross-section; (e) the clip means is a generally wishbone-shaped clip having two oppositely disposed clip prongs; (f) the nozzle means includes screw threads; and (g) the jet means has a slit aperture.

Defined broadly, the present invention is a swimming pool cleaning device adapted to be used with a conventional swimming pool cleaning pole and a conventional water hose, comprising: (a) a first portion and a second portion; (b) the first portion having means for attachment to the cleaning pole; (c) the second portion having a hollow with a first aperture and a second aperture, and nozzle means for adapting the water hose; (d) the hollow gradually converged towards the second aperture; and (e) the nozzle means extended to the first aperture such that water from the water hose can flow through the first aperture into the hollow; (f) whereby direct pressurized and intensified water current can be spurted out of the second aperture to clean submerged swimming pool surfaces.

Defined more broadly, the present invention is a swimming pool cleaning device adapted to be used with a conventional swimming pool cleaning pole and a conventional water hose, comprising: (a) a body having a hollow with a large aperture and a small aperture; (b) said body having means for attaching the cleaning pole; (c) said body further having nozzle means extended to the large aperture for connecting the water hose such that water from the water hose can flow through the large aperture into the hollow; and (d) said body being configured such that said aperture is set at an angle relative to said large aperture; (e) whereby direct pressurized and intensified water current can be spurted out of the small aperture to clean submerged swimming pool surfaces.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and the disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A swimming pool cleaning device adapted to be used with a conventional swimming pool cleaning pole and a conventional water hose, comprising:

a. a first portion and a second portion, the first portion and the second portion obliquely bridged and offset by an angled portion;

b. said first portion having clip means for attachment to the cleaning pole;

c. said second portion having a hollow with a first aperture and a second aperture, nozzle means for connection to the water hose, and jet means for spurting water;

d. said second portion being curved from said first aperture towards said second aperture, and said hollow gradually converged from said first aperture towards said second aperture;

e. said nozzle means extended to said first aperture such that water from the water hose can flow through said first aperture into said hollow; and f. said jet means extended to said second aperture such that water in said hollow can flow through said second aperture and spurt out from said jet means;

g. whereby direct pressurized and intensified water current can be spurted out of said jet means to clean submerged swimming pool surfaces.

2. The invention as defined in claim 1 wherein said first portion, said second portion and said angled portion are made of a unitary piece of solid plastic.

3. The invention as defined in claim 1 wherein said first portion is generally semi-circular in cross-section.

4. The invention as defined in claim 1 wherein said second portion is generally circular in cross-section.

5. The invention as defined in claim 1 wherein said angled portion is generally flat in cross-section.

6. The invention as defined in claim 1 wherein said clip means is a generally wishbone-shaped clip having two oppositely disposed clip prongs.

7. The invention as defined in claim 1 wherein said nozzle means includes screw threads.

8. The invention as defined in claim 1 wherein said jet means has a slit aperture.

* * * * *